United States Patent [19]

Farcasiu et al.

[11] 4,243,539

[45] Jan. 6, 1981

[54] ANTIOXIDANT STABILIZED LUBRICANT COMPOSITIONS

[75] Inventors: Malvina Farcasiu, Princeton; Susan D. Brandes, Trenton, both of N.J.

[73] Assignee: Mobil Oil Corporation, New York, N.Y.

[21] Appl. No.: 64,143

[22] Filed: Aug. 6, 1979

[51] Int. Cl.[3] ..... C10M 1/20

[52] U.S. Cl. ..... 252/52 R; 204/158 R; 252/404; 260/396 R; 260/396 N; 568/729

[58] Field of Search ..... 252/52 R, 404; 204/158 R

[56] References Cited

U.S. PATENT DOCUMENTS

| | | | |
|---|---|---|---|
| 2,686,814 | 8/1954 | Jones | 252/52 R X |
| 3,211,652 | 10/1965 | Hinkamp | 252/52 R X |
| 4,008,136 | 2/1977 | Williams | 204/158 R |
| 4,090,970 | 5/1978 | Braid | 252/52 R X |

FOREIGN PATENT DOCUMENTS

| | | | |
|---|---|---|---|
| 490229 | 2/1953 | Canada | 252/52 R |
| 539809 | 4/1957 | Canada | 252/52 R |

*Primary Examiner*—Andrew Metz

*Attorney, Agent, or Firm*—Charles A. Huggett; Howard M. Flournoy

[57] ABSTRACT

Lubricant compositions are stabilized against oxidative degradation by incorporating therein a minor effective amount of a reaction product produced from singlet oxygen and a hindered bis-p-methylphenol.

11 Claims, 1 Drawing Figure

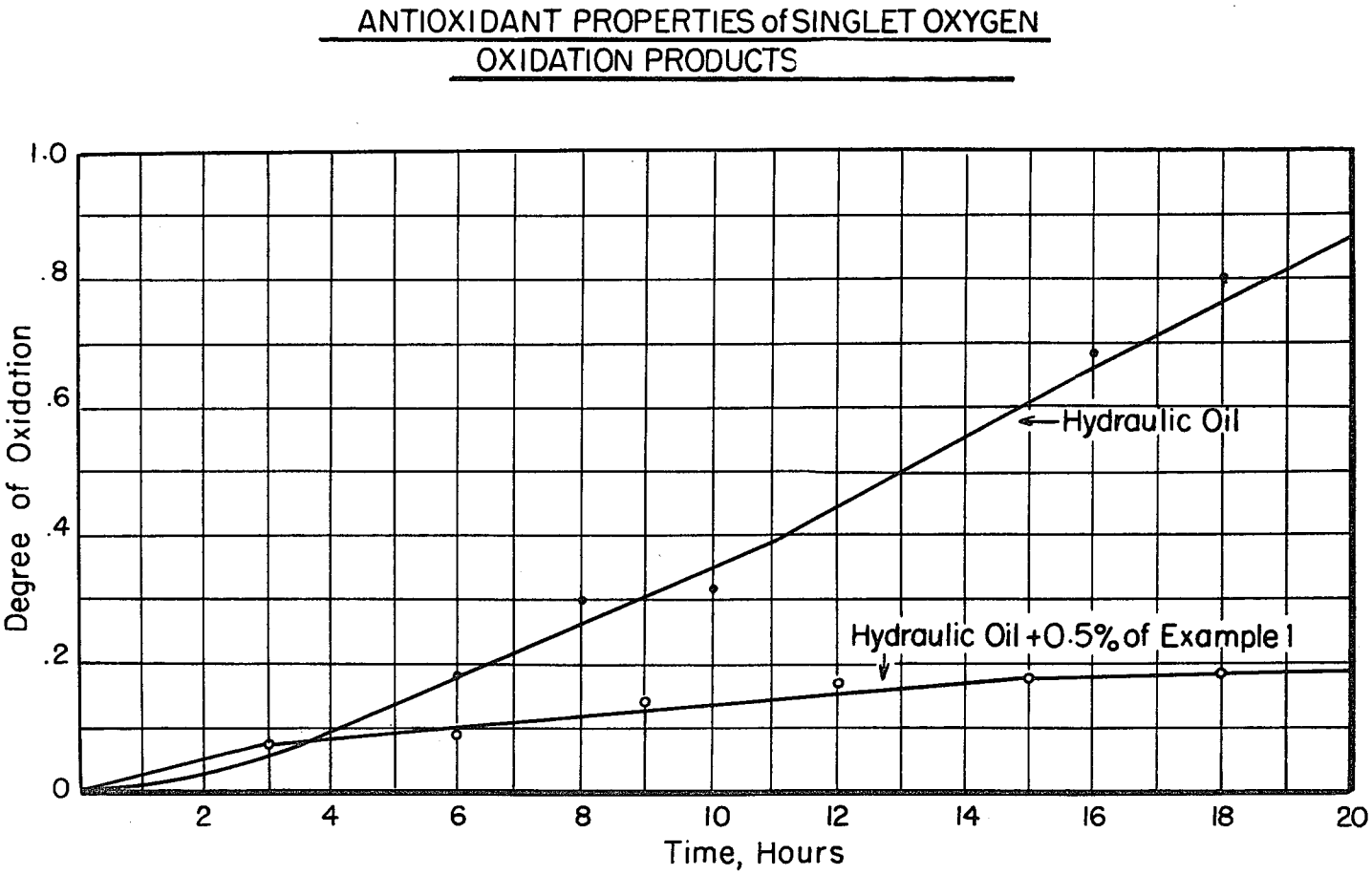
ANTIOXIDANT PROPERTIES of SINGLET OXYGEN
OXIDATION PRODUCTS
Hydraulic Oil
Hydraulic Oil +0.5% of Example 1
Degree of Oxidation
1.0
.8
.6
.4
.2
0
2
4
6
8
10
12
14
16
18
20
Time, Hours

ANTIOXIDANT STABILIZED LUBRICANT COMPOSITIONS

BACKGROUND OF THE INVENTION

1. Field of the Invention

This invention relates to lubricant compositions having improved stability properties. More particularly it relates to lubricants having incorporated therein minor effective amounts of the reaction product of singlet oxygen and hindered bis-p-methylphenols.

2. Summary of the Prior Art

It is well known that lubricants are subject to oxidative degradation. This may occur, for example, as a result of elevated temperatures or of prolonged exposure to the elements. Such degradation or deterioration frequently leads to a loss of lubrication properties and in especially severe cases to a mechanical breakdown of the device being lubricated. Many additives have been tried in an effort to reduce oxidative degradation. Some are only minimally effective unless added in high concentration, and others cause undesirable side effect. However, no references are known to applicants which disclose or fairly suggest this invention.

BRIEF DESCRIPTION OF THE DRAWINGS

The drawing illustrates the excellent antioxidant properties of the hereindescribed additives in hydraulic oil.

DESCRIPTION OF SPECIFIC EMBODIMENTS

In general the additives in accordance with this invention are prepared by reacting singlet or molecular oxygen with a hindered bis-p-methylphenol. The reaction may take place in a concentrated oil solution or in a suitable solvent solution. The exact nature of the singlet oxygen oxidation products are not fully known. However, the hindered p-methylphenols utilized can form semiquinoid structures. In general a 0.5 to 5 wt % solution of the p-methyl bisphenol is oxidized in oil or in a solvent solution while irradiating with strong visible light for about 1 to 3 hours at temperatures of from about 10° to 30° C. A photosensitizer is usually used when the oxidation takes place in a solvent solution. Also, the oil solution may be comprised of synthetic or mineral oils of lubricating viscosity.

The hindered bisphenols useful herein have the following general formula:

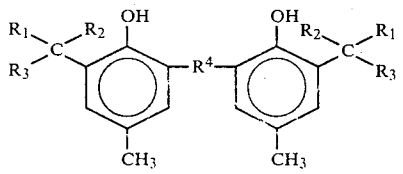

where $R^1$, $R^2$ and $R^3$ are $C_1$–$C_{20}$ alkyl and $R^4$ is $C_1$–$C_{12}$ alkylene.

Any suitable hindered bis-p-methylphenols may be used as for example, 2,2′-methylene-bis(4-methyl-6-t-butylphenol), Preferred is 2,2′-methylene-bis(2,6di-t-butylphenol.

Suitable solvents include methanol, carbon tetrachloride and dichloreomethane, and related alcohols respectively halogen derivatives. Preferred is carbon tetrachloride.

Any suitable photosensitizer may be used. Preferred is zinc porphirine. A minor amount is used, i.e., from about 0.01 to 0.5 wt %.

The lubricants which may be improved by such oxidation products are mineral oils, mineral oil fractions, synthetic and mixed mineral and synthetic lubricating oils or greases made therefrom. The mineral oils will be understood to embrace not only the paraffinic, but also the naphthenic members. By synthetic oils are meant synthetic hydrocarbons, polyalkylene oxide oils, polyacetals, polysilicones and the like, as well as synthetic ester oils. Of the latter type there may be mentioned those esters made from monohydric alcohols and polycarboxylic acids, such as 2-ethylhexyl axelate and the like, and those made from polyhydric alcohols and aliphatic monocarboxylic acids. Those of this group are especially important, and they include esters prepared from the trimethylols, such as the ethane, propane and butane derivatives thereof, 2,2-disubstituted propane diols and the pentaerythritols with aliphatic monocarboxylic acids containing from about 4 to about 9 carbon atoms. Mixtures of these acids may be used to prepare the esters. Preferred in the practice of this invention are the esters pepared from a pentaerythritol and a mixture of $C_5$–$C_9$ acids. In making such esters, a generally acceptable product can be made from commercial pentaerythritol containing about 88% of monopentaerythritol and 12% dipentaerythritol.

Such lubricants adapted for use as hydraulic oils are preferred embodiments.

In general the additives disclosed herein are effective at low concentrations i.e., from about 0.01% to about 3% by weight of the lubricant and preferably from about 0.05 to 1.5% by wt. The additives embodied herein are compatible with any of the standard additive systems known in the art and may be used with same without losing effectiveness. In a lubricant adapted for use as a hydraulic oil the preferred concentration is from 0.2 to 0.5 wt. %.

EXAMPLE 1

A 5% solution of 2,2-methylene-bis(4-methyl-6-t-butyl phenol in a solvent refined lubricant base stock oil was oxidized with singlet oxygen by irradiating the solution with strong visible light (irradiation was with a 600 W. Tesla HPZ halogen bulb) for three hours at atmospheric pressure and a temperature of 30° to 40° C. One gram of the solution was diluted with a typical mixture of lubricating oil containing standard known additives and used in a test developed to measure the stability of oils of lubricating viscosity toward oxidation while exposed to visible light irradiations, see the FIGURE for results.

EXAMPLE 2

A 1% solution of 2,2-methylene-bis(4-methyl-6-t-butylphenol) in carbon tetrachloride was oxidized in the presence of a photosensitizer with singlet oxygen by irradiating the solution with strong visible light for 2.5 hrs. The solvent was removed by evaporation and unreacted phenol by liquid chromatography. Ultraviolet adsorption of the oxidation products and the NMR spectroscopy indicate the presence of the dimer and polymer structure with quinone rings.

The FIGURE illustrates the excellent antioxidant characteristics of the singlet oxygen oxidation products in accordance with the invention and specifically of the oxidation products of 2,2'-methylenebis(4-methyl-6-t-butyl phenol), i.e., Example 1.

It is understood that only preferred embodiments have been illustrated and departure therefrom is clearly the scope of this specification.

We claim:

1. A lubricant composition comprising a major amount of a lubricating oil or grease prepared therefrom and a minor amount sufficient to impart antioxidant or stabilization properties thereto of the reaction product of singlet oxygen and a hindered bis phenol having the general formula:

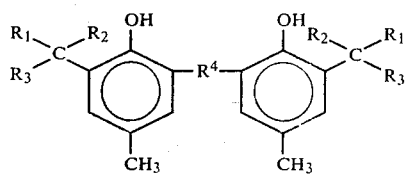

where $R^1$, $R^2$ and $R^3$ are $C_1$–$C_{20}$ alkyl and $R^4$ is $C_1$–$C_{12}$alkylene.

2. The composition of claim 1 where $R^1$, $R^2$ and $R^3$ are methyl.

3. The composition of claim 2 where $R^4$ is methylene.

4. The composition of claim 2 where $R^4$ is butylidene.

5. The composition of claim 1 where the lubricant is a synthetic oil.

6. The composition of claim 2 where the lubricant is a mineral oil.

7. The composition of claim 6 where the mineral oil is adapted for use as a hydraulic oil.

8. A process for preparing singlet oxidation products suitable for use as antioxidant additives comprising reacting in a suitable reaction medium singlet oxygen with a hindered bis-p-methylphenol as described in claim 1 by exposing same to strong visible light for periods of from about 1 to 3 hours, at temperatures of from about 10° to about 30° C and, optionally, in the presence of a photosensitizer.

9. The process of claim 8 where the reaction medium is a mineral or synthetic oil.

10. The process of claim 8 where the reaction takes place in the presence of a suitable photosensitizer and the reaction medium is a solvent selected from halogenated hydrocarbons or lower alcohols.

11. The antioxidant additive produced by the process of claim 8.

* * * * *